US005101614A

United States Patent [19]

Bozanich

[11] Patent Number: 5,101,614

[45] Date of Patent: Apr. 7, 1992

[54] ROTATIONALLY MOLDED SADDLETREE

[76] Inventor: John N. Bozanich, 33024 Globe Dr., Springville, Calif. 93257

[21] Appl. No.: 481,578

[22] Filed: Feb. 16, 1990

[51] Int. Cl.[5] ..... B68C 1/02
[52] U.S. Cl. ..... 54/44
[58] Field of Search ..... 54/44

[56] References Cited

U.S. PATENT DOCUMENTS

| | | | |
|---|---|---|---|
| 3,293,828 | 12/1966 | Hessler | 54/44 |
| 3,371,467 | 3/1968 | Salisbury, III | 54/44 |
| 3,712,024 | 1/1973 | Nankivell | 54/44 |
| 4,771,590 | 9/1988 | Bates | 54/44 |

*Primary Examiner*—Robert P. Swiatek
*Attorney, Agent, or Firm*—Christie, Parker & Hale

[57] ABSTRACT

A hollow saddletree which is sufficiently flexible to conform to the sides of the horse is formed by rotational molding and is of hollow construction.

7 Claims, 2 Drawing Sheets

ROTATIONALLY MOLDED SADDLETREE

BACKGROUND OF THE INVENTION

The present invention relates to saddletrees. Although the form and appearance of saddles has evolved over a period of years, saddles have predominantly been made from leather that is formed and shaped over a saddletree which provides the rigidity and strength required in usage.

Normally saddletrees are substantially rigid and have traditionally been made from wood and rawhide by hand. Saddletrees of wood have evolved into a customary shape in which two spaced apart longitudinal members known as treerails or sidebars are joined at the front and rear by saddle bow or pommel and cantle members. Saddletrees have been formed by carving and routing and joining processes into shapes that would best accommodate the leather construction of the saddle.

Manufacture of saddles based on wood is a relatively expensive process and includes the use of rawhide to bind and strengthen the assembled saddletree.

Attempts have been made to reduce the cost of the saddletree construction through the use of fiberglass reinforced plastics. Saddletrees of this nature are described in U.S. Pat. No. 3,293,828 to Hessler incorporated herein by reference. The problem with fiberglass reinforced saddletrees is that they are too rigid, are not durable and, under the stresses of usage, show a distinct tendency to break down. In addition, saddletrees formed of fiber reinforced plastics, as well as wood saddletrees, are too stiff and do not conform to the horse's back. In consequence, they cause abrasion to the sides of the horse, to the material discomfort of the horse. Saddles formed of foam-filled fiber reinforced plastics have also been described in U.S. Pat. No. 3,258,894 to Hoaglin. In this construction, two sections are molded from fiber reinforced plastic, combined together and the interior filled with urethane foam.

Injected molded saddles have also been tried and described in U.S. Pat. Nos. 3,712,024 and 3,780,494. High cost of molding, difficulty of quality control and lack of versatility have been the problems with injected molded saddles.

It would be desirable to offer a saddletree which would afford low cost and a high degree of comfort heretofore not realized in the art.

SUMMARY OF THE INVENTION

According to the present invention, there is provided a hollow saddletree formed of rotationally molded cross-linked polyethylene. The saddletree consists of two front jockey members and two rear jockey members, respectively joined by bridging pommel and cantle members, the front and rear jockeys being joined by longitudinally extending seat members forming an open, spine-embracing central section connecting with channels extending through the pommel and cantle. The entire saddletree is hollow, of unitary, one piece construction and formed of cross-linked polyethylene by a rotational molding process. All the structural elements of the saddle which form a hollow unit are of substantially equal thickness. The saddletree is durable to withstand long use and, because it is hollow, is light and sufficiently flexible to conform to the contours of back of the horse, eliminating thereby fatigue and abrasion and permitting support for a saddle which provides riding comfort to both the user and the horse heretofore unrealized in the art. Because the zone between the longitudinally extending seat portions is open, the spine of the horse is not contacted to the comfort of the horse, and the ability of the saddletree to conform to the back and sides of the horse. This adds to the confort and enables the rider to have greater control over the horse without the need of heel or spurs.

DETAILED DESCRIPTION

According to the present invention, there is provided a hollow saddletree formed by rotational molding using cross-linked polyethylene.

Broadly, the saddletree comprises a hollow frontal piece adapted to bridge the spine of the horse, a hollow rear piece also adapted to bridge the spine of the horse, the frontal and rear pieces being connected by a pair of integrally molded tree rails which extend longitudinally along the opposed sides of the spine of the horse. Except when used for pack applications, the frontal member includes a pommell and the rear member a cantle. The hollow one piece seamless construction is sufficiently flexible to conform to the contours of the horse for maximum confort.

Figure 1:
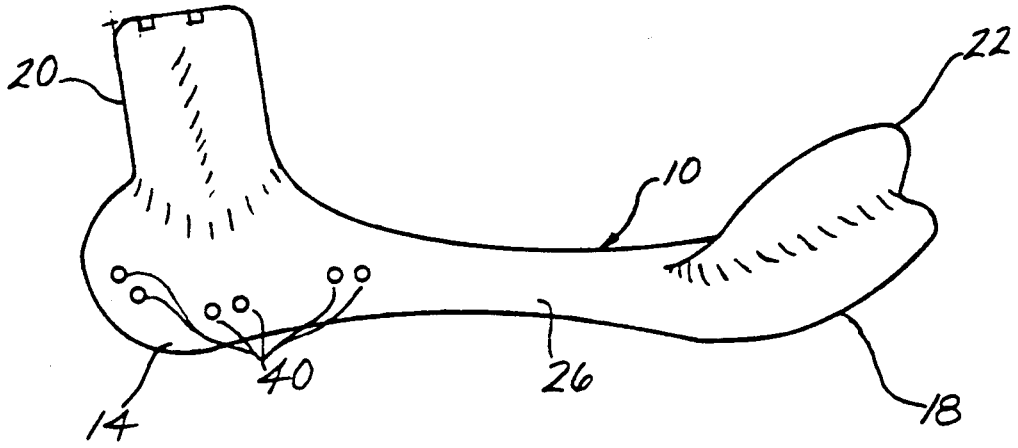
FIG. 1 is a side elevational view of a rotationally molded saddletree.
Figure 2:
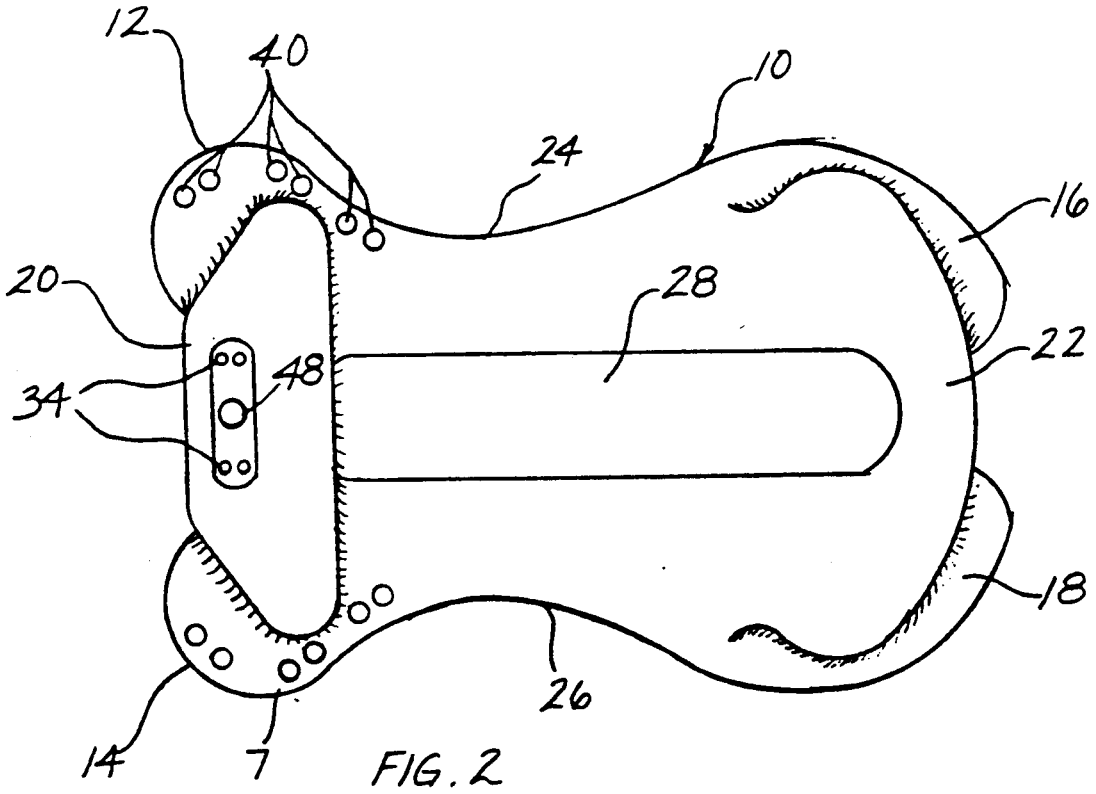
FIG. 2 is a top view of the saddletree shown in FIG. 1.
Figure 3:
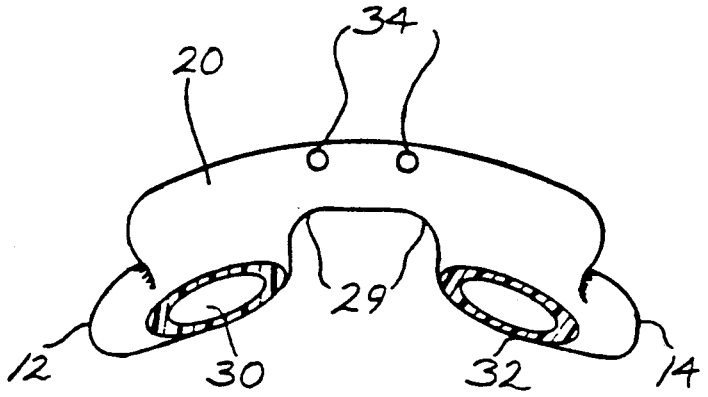
FIG. 3 is a frontal sectional view to depict hollow construction of the saddletree.

With reference to FIGS. 1, 2 and 3, saddletree 10 consists of two hollow molded front jockey members 12 and 14, and two hollow molded rear jockey members 16 and 18, the front jockey members coupled by and an integral part of a hollow molded pommel or swell 20, and the rear jockey members coupled by and an integral part of a hollow molded cantle or seatback 22. Connecting jockeys 12 and 16 and 14 and 18 are hollow molded, longitudinally extending rail members 24 and 26, forming therebetween an opening 28 to accommodate the spine of the horse. The pommel 20 and cantle 22 which respectively extend between jockey members 12 and 14 and 16 and 18 "AS" depicted in FIG. 3, providing channel 29 in pommel 20 and a comparable channel in cantle 22 (not shown), enables the saddletree to embrace the spine of the horse.

The saddletree is formed by rotational molding using cross-linked polyethylene as described in U.S. Pat. No. 4,330,495 to Halle et al. incorporated herein by reference. Rotational molding is a process where a mold, which conforms to the exterior configuration of the saddletree, is filled with particulate polymer and closed. The mold is heated and cooled while rotating about two perpendicular axes simultaneously. Heating causes the polymeric material to flow within the mold and conform to and adopt the shape of the mold to form a unitary item of substantially uniform wall thickness. The ability to flow is terminated upon cure. The mold is cooled and opened, and there is produced an article having precisely the shape of the mold. In the saddletree formed, all elements are joined together in the unitary, hollow construction of uniform cross sections as depicted by the hollow, cut-away segments 30 and 32 of FIG. 3. The rotational molding process is adaptive to provide for the inclusion of inserts, areas where accessories can be added, and pilot holes for the later addition of inserts.

There is desirably molded as part of the pommel 20 inserts 34 adaptive to receive bolts to secure the plate 36 bearing horn 38 to saddletree 10. It is also preferably desired to integrally mold inserts 40 for adding stirrups and the like. In the alternative, holes can be drilled into the saddle for later insertion of the inserts. The same is true for providing inserts for the horn to enable the addition of any type of horn of fancy to the user. The longitudinal opening 28 and channels 29 provided in the saddletree accommodate the spinal column of the horse and reduce pressure on the back of the horse and enhance flexing to conform to the sides of the horse.

Figure 4:
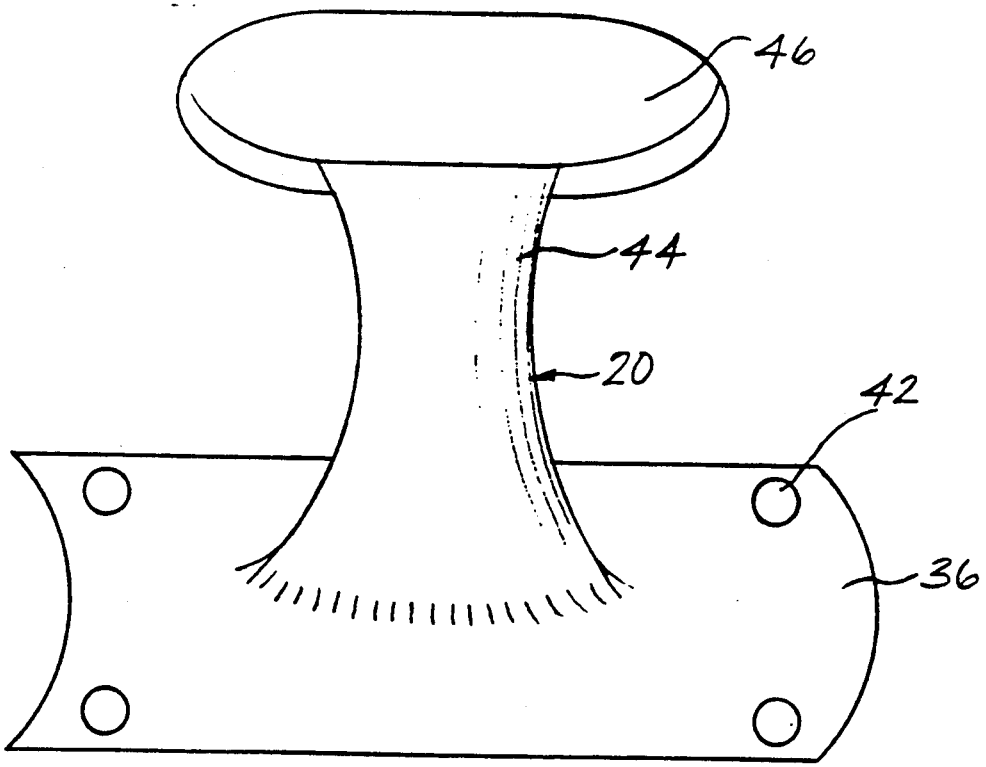
FIG. 4 is a view of a horn which may be secured to the saddletree.

FIG. 4 depicts a horn 38 which consists of a plate 36 providing holes 42 for securing the horn to the saddletree and includes horn neck 44 and cap 46 which are integrally formed as part of the horn.

While the general shape of the saddle is as provided herein, the shape can be modified to accommodate the use to which the saddle will be placed. For instance, the coupling pommel and cantle can be modified in shape to accommodate the needs of a pack animal while still allowing molding of unitary, one-piece construction with sufficient flexibility to enable the saddletree to conform to the back of the animal, substantially eliminating abrasion during use.

Because the saddletree is hollow, a plug (not shown) can be provided during holding or later for the addition of weights such as sand, lead shot or the like, for training or like purposes. Typically the opening 48 for addition of a weight is located in the pommel such as by removal of a section where the horn is attached. This eliminates the need for the rider to carry weights during training operations. Wall thickness will vary depending on use varying from about ⅛ inch or less for cross country racing to ¼ inch or more for a roping saddle.

What is claimed is:

1. A molded saddletree comprising a flexible, hollow one piece seamless molded of substantially uniform wall thickness providing a frontal section including means for bridging the spine of a horse, a rear section including means for bridging the spine of a horse, said frontal and rear sections integrally molded to and part of opposed transverse rail members connecting aid frontal section to said rear section, said transverse rail members adapted to be positioned to be on opposed sides of the spine of the horse, said saddle having sufficient flexibility to conform to the sides of a horse, and formed of rotationally molded cross-linked polyethylene.

2. A saddletree as claimed in claim 1 in which the frontal section included a integrally molded hollow pommel and the rear section included an integrally molded cantle.

3. A saddletree as claimed in claim 1 in which the wall thickness is from about ⅛" to about ¼".

4. A saddletree comprising a flexible rotationally molded, hollow seamless one-piece molding of substantially uniform wall thickness and including:

a) a pair of frontal jockey members bridged by and integrally molded and part of a pommel containing a channel to embrace the spine of a horse; and b) a pair of rear jockey members bridged by and integrally molded and part of a cantle containing a channel to embrace the spine of a horse; and c) a pair of opposed, longitudinally extending rail members, each coupling a front and rear jockey and forming therebetwen an opening for the spine of a horse, said saddletree being formed of cross-linked polyethylene.

5. A saddletree according to claim 4 in which the pommel includes means to secure a horn to the saddletree.

6. A saddletree accoruing to claim 4 which includes means on the frontal jockey members to secure stirrups to the saddletree.

7. A saddletree as claimed in claim 4 in which the wall thickness is from about ⅛" to about ¼".

* * * * *